US010508603B2

(12) United States Patent
Nishida et al.

(10) Patent No.: US 10,508,603 B2
(45) Date of Patent: Dec. 17, 2019

(54) APPARATUS FOR CONTROLLING INTERNAL COMBUSTION ENGINE

(71) Applicant: TOYOTA JIDOSHA KABUSHIKI KAISHA, Toyota-shi, Aichi (JP)

(72) Inventors: Hideyuki Nishida, Suntou-gun (JP); Tatsuo Kobayashi, Susono (JP)

(73) Assignee: TOYOTA JIDOSHA KABUSHIKI KAISHA, Toyota-shi, Aichi (JP)

( * ) Notice: Subject to any disclaimer, the term of this patent is extended or adjusted under 35 U.S.C. 154(b) by 135 days.

(21) Appl. No.: 15/512,600

(22) PCT Filed: Aug. 10, 2015

(86) PCT No.: PCT/JP2015/004012
§ 371 (c)(1),
(2) Date: Mar. 20, 2017

(87) PCT Pub. No.: WO2016/056160
PCT Pub. Date: Apr. 14, 2016

(65) Prior Publication Data

US 2017/0292460 A1 Oct. 12, 2017

(30) Foreign Application Priority Data

Oct. 9, 2014 (JP) ..... 2014-207869

(51) Int. Cl.
*F02D 13/02* (2006.01)
*F02D 41/12* (2006.01)
(Continued)

(52) U.S. Cl.
CPC ..... *F02D 13/0215* (2013.01); *F02B 63/04* (2013.01); *F02D 41/123* (2013.01);
(Continued)

(58) Field of Classification Search
CPC .... F02D 13/0215; F02D 41/123; F02D 41/26; F02D 41/3005; F02D 2041/001; F02B 63/04
(Continued)

(56) References Cited

U.S. PATENT DOCUMENTS 4,805,571 A * 2/1989 Humphrey ..... F01L 1/348 123/250
5,537,975 A * 7/1996 Cosma ..... F01L 13/065 123/322
(Continued)

FOREIGN PATENT DOCUMENTS

DE 10 2005 001 245 A1 7/2006
DE 10 2012 001 579 A1 8/2013
(Continued)

OTHER PUBLICATIONS

International Search Report of PCT/JP2015/004012, dated Nov. 19, 2015. [PCT/ISA/210].
(Continued)

*Primary Examiner* — Hung Q Nguyen
*Assistant Examiner* — Susan E Scharpf
(74) *Attorney, Agent, or Firm* — Sughrue Mion, PLLC

(57) ABSTRACT

An apparatus for controlling an internal combustion engine is provided. An engine includes a compression release mechanism and a fuel injection valve. The compression release mechanism variably controls the opening degree of a valve member, and thereby connects the combustion chamber of the engine with at least one of the intake passage and the exhaust passage in order to release in-cylinder pressure during at least the compression stroke. A controller controls the fuel injection valve to execute coasting with the fuel cut off in which the fuel is cut off under a predetermined condition, and while executing coasting with the fuel cut off,
(Continued)

controls the compression release mechanism to increase the opening degree of the valve member of the compression release mechanism as the speed of the engine is higher.

2 Claims, 20 Drawing Sheets

(51) Int. Cl.
*F02B 63/04* (2006.01)
*F02D 41/26* (2006.01)
*F02D 41/30* (2006.01)
*F02D 41/00* (2006.01)

(52) U.S. Cl.
CPC ..... *F02D 41/26* (2013.01); *F02D 41/3005* (2013.01); *F02D 2041/001* (2013.01)

(58) Field of Classification Search
USPC ..... 701/104
See application file for complete search history.

(56) References Cited

U.S. PATENT DOCUMENTS 5,899,828 A 5/1999 Yamazaki et al.
8,087,396 B2 * 1/2012 Hou ..... F01L 1/18 123/321
9,683,496 B2 * 6/2017 Kojima ..... F02D 37/02
2007/0163531 A1 * 7/2007 Lewis ..... F01L 9/02 123/179.4
2009/0152027 A1 * 6/2009 Kusaka ..... B60K 6/445 180/65.28
2011/0120422 A1 * 5/2011 Hou ..... F01L 1/18 123/493
2014/0074378 A1 * 3/2014 Iwai ..... F02D 43/04 701/104
2015/0059688 A1 * 3/2015 Kojima ..... F02D 37/02 123/305

FOREIGN PATENT DOCUMENTS

JP 2-064239 A 3/1990
JP 9-256828 A 9/1997
JP 10-002239 A 1/1998
JP 2004-293556 A 10/2004
JP 2005-061286 A 3/2005
JP 2011-027067 A 2/2011

OTHER PUBLICATIONS

Written Opinion of PCT/JP2015/004012, dated Nov. 19, 2015. [PCT/ISA/237].

* cited by examiner

APPARATUS FOR CONTROLLING INTERNAL COMBUSTION ENGINE

CROSS REFERENCE TO RELATED APPLICATIONS

This application is a National Stage of International Application No. PCT/JP2015/004012 filed Aug. 10, 2015, claiming priority based on Japanese Patent Application No. 2014-207869, filed Oct. 9, 2014, the contents of all of which are incorporated herein by reference in their entirety.

TECHNICAL FIELD

The present invention relates to an apparatus for controlling an internal combustion engine, and more particularly, to an apparatus that controls an internal combustion engine equipped with a compression release mechanism for releasing in-cylinder pressure.

BACKGROUND ART

An internal combustion engine equipped with a compression release mechanism (or decompressor) that connects the combustion chamber with an intake passage and/or an exhaust passage during a compression stroke is commonly known. According to such a compression release mechanism, in-cylinder pressure is released during startup or when coasting with the fuel cut off, thereby reducing the load on the startup motor during startup, and also suppressing deceleration shock when starting coasting with the fuel cut off.

One type of compression release mechanism controls the lift amount of an intake valve and/or an exhaust valve, so as to put the intake valve and/or the exhaust valve into a constant open state at least during the compression stroke. Another type of compression release mechanism is equipped with a dedicated valve for selectively putting the combustion chamber and the exhaust passage into a communicating (open) state or a non-communicating (closed) state.

With the device disclosed in Patent Literature 1, while coasting with the fuel cut off, if at least a predetermined degree of deceleration is conducted and the battery is not fully charged, an intake valve and an exhaust valve are fully opened by the compression release mechanism, thereby causing the combustion chamber to communicate with the intake passage and the exhaust passage during the compression stroke, and conducting electric power regeneration. According to this configuration, deceleration shock caused by engine deceleration torque during braking operation may be decreased, and additionally, engine power losses (i.e. pumping losses) may be reduced to facilitate electric power regeneration.

CITATION LIST

Patent Literature

PTL 1: Japanese Patent Laid-Open No. H10-2239(1998)

SUMMARY OF INVENTION

It is desirable to suppress the energy consumption required by operation of the compression release mechanism. Energy consumption of the compression release mechanism is generally proportional to the valve opening degree. Consequently, if the valve opening degree is made smaller, the energy consumption for opening the valve member to that opening degree can be suppressed. However, if the valve opening degree of the compression release mechanism is small while coasting with the fuel cut off, significant pumping losses occur in the region of high engine speed, and inertial energy cannot be utilized effectively.

The present invention was devised in light of the above circumstances, and an objective thereof is to suppress pumping losses in the region of high engine speed while also suppressing the energy consumed by the operation of a compression release mechanism while coasting with the fuel cut off, thereby facilitating the efficient utilization of inertial energy.

Solution to Problem

According to an aspect of the present invention, there is provided an apparatus for controlling internal combustion engine comprising:

a compression release mechanism controller configured to control a compression release mechanism that variably controls an opening degree of a valve member, the compression release mechanism being a mechanism that connects a combustion chamber of an internal combustion engine of a vehicle to at least one of an intake passage and an exhaust passage by an opening degree of the valve member, at least during a compression stroke; and a fuel cutoff controller configured to control a fuel injection valve that supplies fuel to the combustion chamber of the internal combustion engine to execute coasting with the fuel cut off, in which the supply of fuel is cut off under a predetermined condition, wherein the compression release mechanism controller is further configured to increase, during execution of coasting with the fuel cut off, the opening degree of the valve member of the compression release mechanism as the speed of the internal combustion engine is higher.

According to the above aspect, when coasting with the fuel cut off, the valve opening degree of the valve member is made larger as the speed of the internal combustion engine is higher. For this reason, in the region of low speed of the internal combustion engine, the energy consumption required by the operation of the compression release mechanism may be suppressed, while in the region of high speed, flow losses may be decreased to suppress pumping losses, thereby facilitating the utilization of inertial energy.

According to another aspect of the present invention, the valve member is an exhaust valve of the internal combustion engine, the compression release mechanism is configured to provide an additional opening degree to the exhaust valve, the internal combustion engine further comprises a variable valve timing mechanism configured to change an operation timing of the exhaust valve, and the apparatus further comprises a valve timing controller configured to control the variable valve timing mechanism, and the valve timing controller is further configured to decrease an upper limit of a retardation of the operation timing of the exhaust valve as the additional valve opening degree is larger.

According to the above aspect, since the upper limit on the retardation of the operation timing of the exhaust valve is made smaller to the extent that the additional opening degree provided by the compression release mechanism is large, even when the opening degree of the exhaust valve is increased by the operation of the compression release mechanism, flow losses may be suppressed while also preventing interference between the exhaust valve and the piston head caused by the retardation of the exhaust valve.

According to another aspect of the present invention, the internal combustion engine further comprises an electric generator mechanically coupled to the output shaft thereof, and the apparatus further comprises an electric generator controller configured to control output from the electric generator, and the electric generator controller is further configured to increase a deceleration torque produced by the electric generator as a difference in power loss between when the compression release mechanism is operating and not operating is larger.

According to the above aspect, the deceleration torque produced by the electric generator is made larger as the difference in power loss between when the compression release mechanism is operating and not operating is larger. Consequently, a lessened sense of deceleration caused by the operation of the compression release mechanism may be minimized, while also making it possible to facilitate power generation by the electric generator.

DESCRIPTION OF EMBODIMENTS

Hereinafter, exemplary embodiments of the present invention will be described on the basis of the attached drawings.

Figure 1:
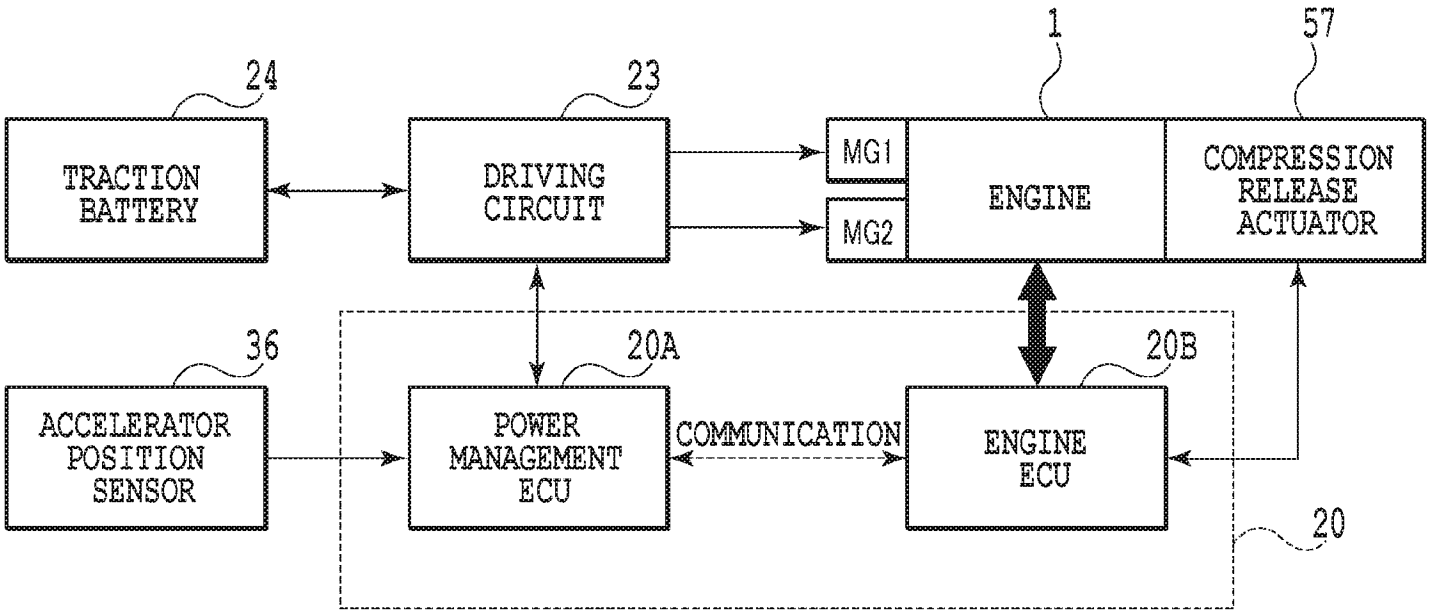
FIG. 1 is a schematic diagram illustrating an overall configuration of an apparatus for controlling an internal combustion engine according to an embodiment of the present invention.

FIG. 1 schematically illustrates an overall configuration of an apparatus for controlling an internal combustion engine according to an embodiment. The internal combustion engine (engine) 1 according to the present embodiment is installed onboard a vehicle. The vehicle is a hybrid vehicle equipped with two sources of motive power: the engine 1 and motor generators. The vehicle is provided with an electronic control unit (hereinafter referred to as ECU) 20 that acts as a controller configured to control the engine 1.

The vehicle is provided with a first motor generator MG1 and a second motor generator MG2. The first motor generator MG1 is mainly used for engine startup, and is also used for electric power generation by utilizing the motive power of the engine 1 when the state of charge of a traction battery 24 falls. The second motor generator MG2 is mainly used as a source of motive power for vehicle traction, and is also used to charge the traction battery 24 by generating electric power utilizing inertial energy when the vehicle decelerates (when the accelerator is released). The first and second motor generators MG1 and MG2 are mechanically coupled to a crank shaft 4 (FIG. 2), which is the output shaft of the engine 1. A torque-splitting mechanism may also be provided, which selectively disengages the mechanical coupling between the first and second first motor generators MG1 and MG2, and the output shaft of the engine 1, and/or changes the transmission gear ratio therebetween.

The ECU 20 is a commonly known single-chip microprocessor, and includes components such as a CPU, ROM, RAM, input/output ports, and a storage device (not illustrated). The ECU 20 is preprogrammed to control the components of the engine 1 as discussed later, on the basis of various input parameters and initial values indicating the state of the vehicle. The ECU 20 implements functions for acting as a compression release mechanism controller, a fuel cutoff controller, a valve timing controller, and a generator controller according to the present invention. The ECU 20 is equipped with a power management ECU 20A and an engine ECU 20B, which are able to communicate with each other. The power management ECU 20A controls the first and second first motor generators MG1 and MG2. The engine ECU 20B controls the engine 1. However, the ECU 20 may also have an integrated configuration, without being split into separate ECUs in this way.

The first and second motor generators MG1 and MG2 are mechanically coupled to a crank shaft 4 (FIG. 2), which is the output shaft of the engine 1. A driving circuit 23 is provided, for controlling the operation of the first and second first motor generators MG1 and MG2 according to control output from the power management ECU 20A. The driving circuit 23 is equipped with an inverter. The inverter converts DC current from the traction battery 24 into AC current for driving the first and second first motor generators MG1 and MG2, and in addition, converts AC current generated by the first and second first motor generators MG1 and MG2 into DC current for charging the traction battery 24. Additionally, the driving circuit 23 is equipped with a converter. The converter raises the voltage of the traction battery 24 to supply DC current to the inverter, and also lowers the voltage generated by the first and second motor generators MG1 and MG2 and converted to DC by the inverter in order to charge the traction battery 24.

The engine 1 is a multi-cylinder (for example, straight 4-cylinder) spark-ignition internal combustion engine. However, features such as the engine type, number of cylinders, cylinder arrangement (such as straight, V, or horizontally-opposed), and ignition method are not limited. For example, the engine 1 may also be a compression-ignition internal combustion engine (diesel engine).

Figure 2:
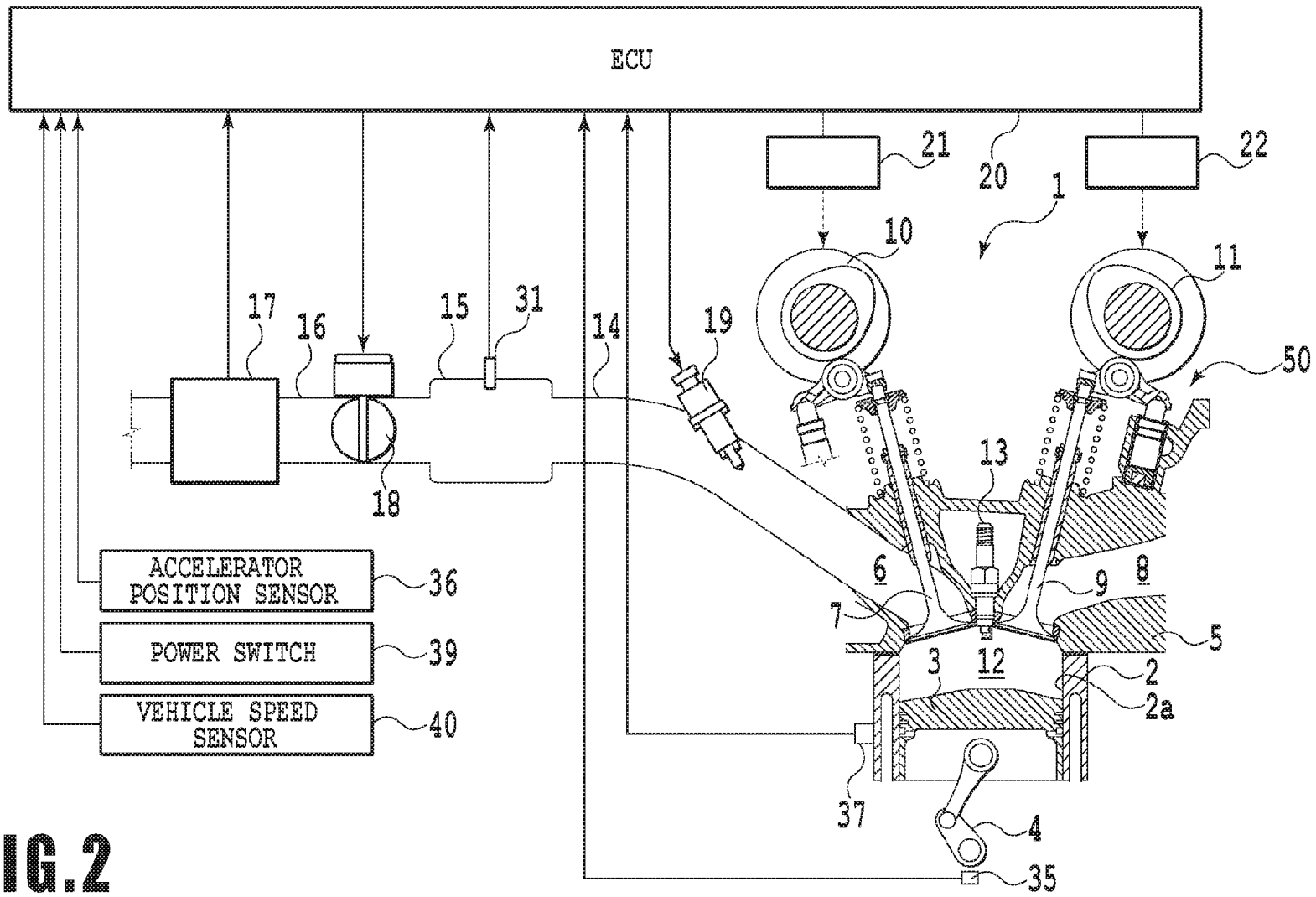
FIG. 2 is a schematic diagram illustrating a configuration of an internal combustion engine and its controller.

FIG. 2 illustrates a configuration of the engine 1 and its controller. A piston 3 is reciprocally housed inside a cylinder 2*a* formed in a cylinder block 2 of the engine 1. The crank shaft 4 constituting the output shaft of the engine 1 is coupled to the piston 3. On a cylinder head 5 of the engine 1, an intake valve 7 that opens and closes an intake port 6 and an exhaust valve 9 that opens and closes an exhaust port 8 are disposed, with two each for each cylinder. Each intake valve 7 and each exhaust valve 9 is driven to open or close by a valve driving mechanism including cam shafts 10 and 11. At the top of the cylinder head 5, a spark plug 13 for igniting an air-fuel mixture inside a combustion chamber 12 is attached for each cylinder.

Variable valve timing mechanisms 21 and 22 are provided in order to alter the opening timings of the intake valve 7 and the exhaust valve 9. For each of the variable valve timing mechanisms 21 and 22 on the intake side and the exhaust side, the relative rotary phase between the cam shaft and the crank shaft is regulated to thereby regulate the opening and closing timings of the intake valve 7 and the exhaust valve 9. The variable valve timing mechanisms 21 and 22 additionally may allow for the regulation of the lift amount of the intake valve 7 and the exhaust valve 9. For the variable valve timing mechanisms 21 and 22, a hydraulic mechanical mechanism enabling discrete or continuous regulation of the rotary phase and/or lift amount is used. Various other commonly known techniques, such as a solenoid valve mechanism, for example, may also be used for the variable valve timing mechanisms 21 and 22.

The intake port 6 of each cylinder is connected to a surge tank 15 constituting an intake collecting chamber via an intake manifold or branch pipe 14 for each cylinder. An intake pipe 16 is connected on the upstream side of the surge tank 15. An air cleaner (not illustrated) is provided on the upstream end of the intake pipe 16. An airflow meter 17 for detecting the intake air amount and an electronically controlled throttle valve 18 are built into the intake pipe 16 in this order from the upstream side. An intake passage is formed by the intake port 6, the branch pipe 14, the surge tank 15, and the intake pipe 16. An injector 19 for injecting fuel into the intake passage, particularly into the intake port 6, is disposed for each cylinder. Note that the injector 19 may be disposed to directly inject fuel into the combustion chamber 12 of the engine 1. The injector 19 may be disposed in both the intake port 6 and the combustion chamber 12.

An exhaust manifold and an exhaust pipe (not illustrated) are connected to the exhaust port 8 of each cylinder. A catalyst made from a three-way catalyst is installed inside the exhaust pipe. On the upstream and downstream sides of the catalyst, upstream and downstream air-fuel ratio sensors for detecting the air-fuel ratio of exhaust gas are installed, respectively. On the basis of the output from these air-fuel ratio sensors, the ECU 20 executes air-fuel ratio feedback control to keep each air-fuel ratio at the stoichiometric ratio (theoretical air-fuel ratio).

In addition to the above airflow meter 17 and the upstream and downstream air-fuel ratio sensors, an intake air pressure sensor 31 for detecting the pressure inside the intake passage, a crank angle sensor 35 for detecting the crank angle of the engine 1, an accelerator position sensor for detecting the accelerator position, a fluid temperature sensor 37 for detecting the coolant temperature of the engine 1, and a speed sensor 40 provided near a wheel are electrically connected to the ECU 20. The ECU 20 is able to detect the speed of the engine 1, or in other words the number of revolutions per unit time, on the basis of a signal from the crank angle sensor 35. A power switch 39 for putting the engine 1 and the first and second first motor generators MG1 and MG2 into an operable state (on) or a stopped state (off) is electrically connected to the ECU 20. On the basis of detected values from these sensors, the ECU 20 controls the spark plugs 13, the throttle valves 18, the injectors 19, and the first and second first motor generators MG1 and MG2. The ECU 20 controls factors such as the ignition timing, the fuel injection amount, the fuel injection timing, the throttle position, and the motor generator output. As illustrated in FIG. 1, the accelerator position sensor 36 is connected to the power management ECU 20A.

For example, the first and second first motor generators MG1 and MG2 are commonly known three-phase AC synchronous motors, and by controlling the excitation current supplied to a field magnet constituting the rotor thereof, the generated electric power and the regenerative torque may be controlled. The ECU 20 executes electric power regeneration control if predetermined electric power regeneration conditions are met (for example, "vehicle speed is decelerating" and "state of charge of the traction battery 24 is a predetermined value or less"). If a target deceleration torque (regenerative target torque) of the second motor generator MG2 is input, the ECU 20 sets a corresponding target power generation voltage within a predetermined range. Next, the ECU 20 calculates an output current command value according to a predetermined formula on the basis of the target deceleration torque, the target power generation voltage, the vehicle speed, the transmission gear ratio, the estimated internal loss, and the angular velocity and temperature of the second motor generator MG2, and calculates a field magnet current command value on the basis of the output current command value and the current output current value. The field magnet current of the calculated field magnet current command value is supplied to the second motor generator MG2 by the driving circuit 23 according to control output from the ECU 20. In this way, the generated electric power and regenerative torque of the second motor generator MG2 may be controlled to a desired value. During electric power regeneration, the first motor generator MG1 is set to a field magnet current value of 0 and allowed to spin freely. Note that another arbitrary type of generator and control method may also be used.

In the engine 1 according to the present embodiment, in order to release the in-cylinder pressure at least during the compression stroke of the engine, a compression release mechanism (or decompressor) 50 that connects the combustion chamber 12 to the exhaust passage (exhaust port 8) is provided.

Figure 3:
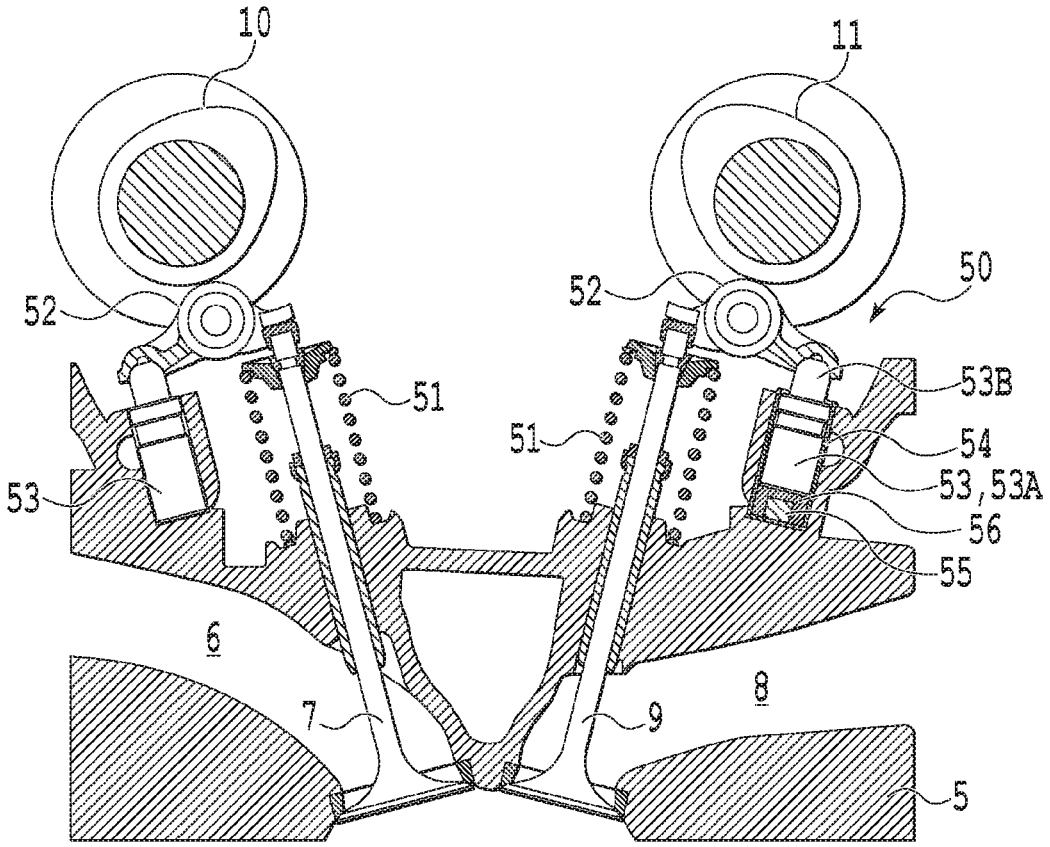
FIG. 3 is an enlarged front cross-section of a compression release mechanism.

The compression release mechanism 50 will now be described with reference to FIGS. 3 and 4. The compression release mechanism 50 according to the present embodiment is configured to provide an additional valve opening degree to the exhaust valve 9 of the engine 1, and thereby at least release in-cylinder pressure (i.e. compression pressure) during the compression stroke. With a compression release mechanism that provides an additional valve opening degree to the exhaust valve, when conducting the compression release operation, an additional valve opening degree is provided with respect to the opening degree of the exhaust valve during normal operation when the compression release operation is not conducted, and compression pressure is released by this additional opening degree. Consequently, the compression release mechanism 50 according to the present embodiment contains the exhaust valve 9 as a structural element. However, the compression release mechanism may also be equipped with a dedicated valve member separate from the exhaust valve 9.

As illustrated in the drawings, the cylinder head 5 is provided with an exhaust cam shaft 11, an exhaust valve spring 51, a rocker arm 52, and a hydraulic lash adjuster (hereinafter, HLA) 53, as structural elements of the valving mechanism for the exhaust valve 9. The exhaust valve spring 51, the rocker arm 52, and the HLA 53 are provided for each exhaust valve 9. The valve driving mechanism for the intake valve 7 is configured similarly. The exhaust valve 9 is biased in the closing direction by the exhaust valve spring 51. The exhaust cam shaft 11 drives the exhaust valve 9 up and down (opening and closing) via the rocker arm 52. The HLA 53, as is commonly known, works to continuously eliminate clearance between the exhaust cam shaft 11 and the rocker arm 52. The HLA 53 includes an HLA body 53A and a plunger 53B. The plunger 53B projects upward from the HLA body 53A, and is able to rise and fall inside the HLA body 53A. Note that a roller arm may also be interposed between the exhaust cam shaft 11 and the rocker arm 52. In this case, the HLA 53 works to continually eliminate clearance between the roller arm and the rocker arm 52.

The exhaust cam shaft 11, the exhaust valve spring 51, the rocker arm 52, and the HLA 53 also constitute structural elements of the compression release mechanism 50. In addition to these, the compression release mechanism 50 is equipped with a plurality of HLA holders 54, a single slider 55, a plurality of HLA lifters 56, and a motorized compression release actuator 57. The HLA holders 54 have a cylindrical shape with a floor, are affixed to the cylinder head 5, and house the HLA 53 while allowing for up-and-down movement. The slider 55 is positioned on the floor of each HLA 53, extending in the cylinder line direction (in other words, in the axis direction of the crank shaft) so as to be inserted through all HLA holders 54. The HLA lifters 56 are disposed in the gaps between a cam face 55A of the slider 55 and the HLA 53. The motorized compression release actuator 57 slides the slider 55 in the cylinder line direction.

The compression release actuator 57 electrically connected to the ECU 20 (particularly the engine ECU 20B; see FIG. 1), and is controlled by the ECU 20. An on/off signal and a signal indicating a target displacement of the compression release actuator 57 are sent from the ECU 20 to the compression release actuator 57. A signal indicating the actual displacement of the compression release actuator 57 is sent from the compression release actuator 57 to the ECU 20.

Figure 4:
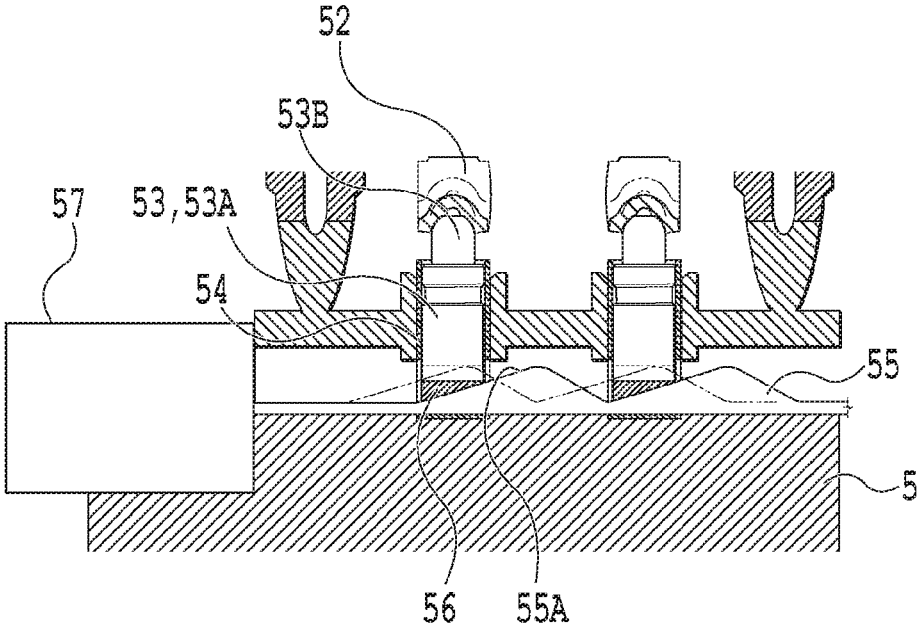
FIG. 4 is an enlarged side cross-section of a compression release mechanism.

When the compression release mechanism 50 operates, the compression release actuator 57 is switched on, and the compression release actuator 57 displaces itself by the target displacement, thereby sliding the slider 55 from the stopped position illustrated in FIG. 4 to an operating position farther to the left (indicated by the virtual line). Subsequently, the cam face 55A of the slider 55 lifts the HLA 53 upward via the HLA lifter 56. As a result, the rocker arm 52 rotates, lifting the exhaust valve 9 in the open direction (downward). Such operation is performed simultaneously on each exhaust valve 9. Consequently, an effect similar to expanding the base circle of the exhaust cam shaft 11 is obtained, and each exhaust valve 9 is lifted without fully closing, at least by a minute amount much smaller than the lift when fully opening.

While the engine 1 is running, the HLA 53 enters an elongated state so as to eliminate clearance between the exhaust cam shaft 11 and the rocker arm 52 when hydraulic pressure is supplied from an oil pump, but the HLA 53 enters a contracted state if hydraulic pressure is no longer supplied, such as when the engine stops. For example, suppose that the amount of contraction from the elongated state to the contracted state is approximately 1.5 mm. For example, if the lift amount of the cam face 55A when the slider 55 is moved from the stopped position to the operating position (equal to the lift amount of the HLA lifter 56) is set to 2.3 mm, when the compression release mechanism 50 is operated such as when the engine stops, the HLA 53 is lifted by the difference 0.8 mm obtained by subtracting the contraction (2.3−1.5=0.8). For example, if the lever ratio of the rocker arm 52 is approximately 1.5:1, the lift amount Ld of the exhaust valve 9 by the operation of the compression release mechanism 50 becomes approximately 0.5 mm. Hereinafter, this lift amount Ld is referred to as a compression release lift amount.

In the present embodiment, a motorized compression release actuator 57 is used rather than a hydraulic one. This is to enable operation even when there is insufficient or no hydraulic pressure supply from the oil pump.

Figure 5:
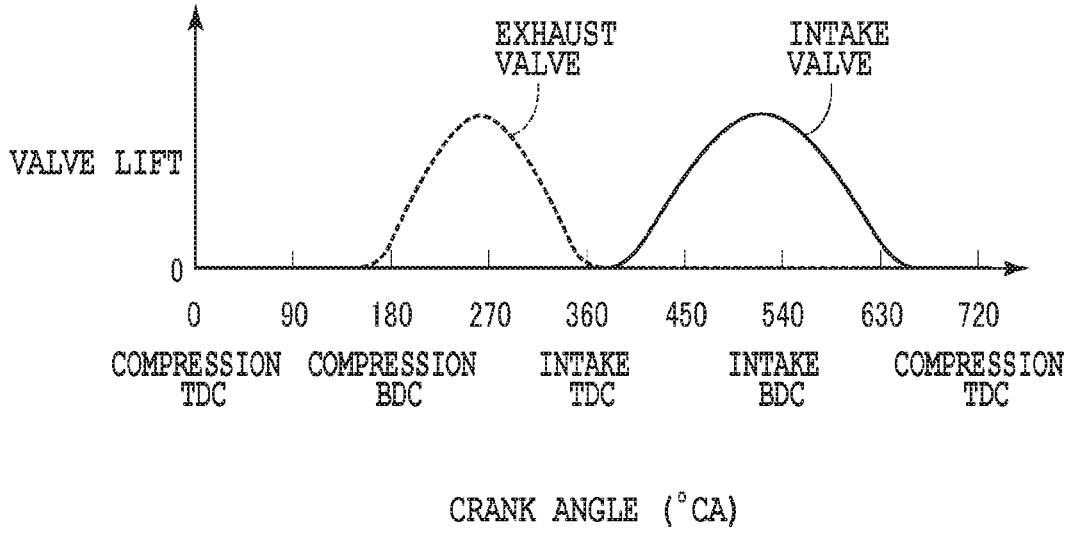
FIG. 5 is a timing chart illustrating changes in the lift amount of an intake valve and an exhaust valve while a compression release mechanism is inactive.
Figure 6:
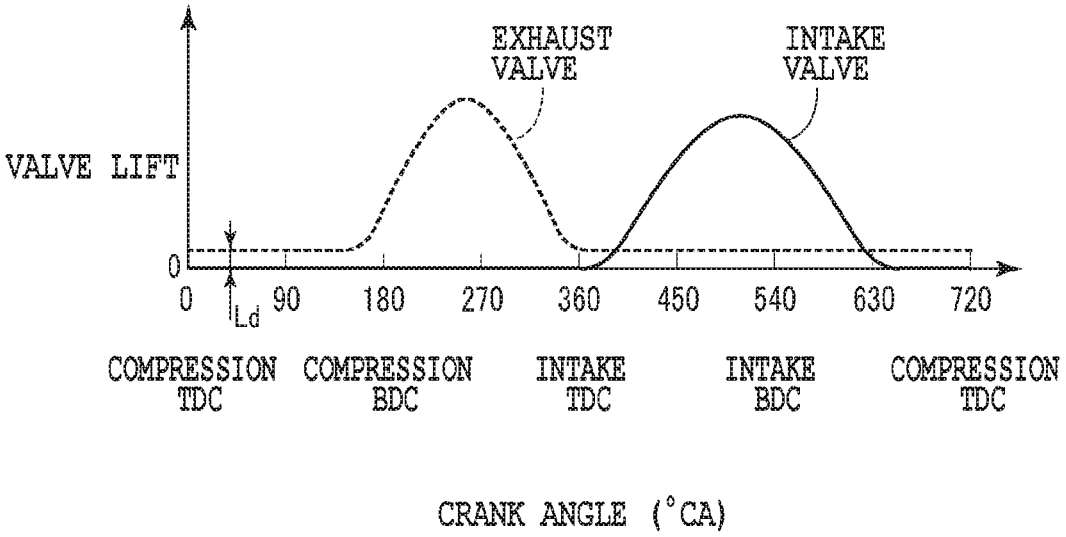
FIG. 6 is a timing chart illustrating changes in the lift amounts of an intake valve and an exhaust valve while a compression release mechanism is active.

FIGS. 5 and 6 illustrate the lift amount of the intake valve 7 and the exhaust valve 9 for a specific cylinder. FIG. 5 illustrates the state when the compression release mechanism 50 is not operating, while FIG. 6 illustrates the state when the compression release mechanism 50 is operating. Note that FIGS. 5 and 6 illustrated data from when the engine is motoring at 1000 rpm.

As FIG. 6 demonstrates, during operation of the compression release mechanism 50, the exhaust valve 9 is kept open continuously, and even at the timing when the exhaust valve 9 closes during non-operation of the compression release mechanism 50 (see FIG. 5), the exhaust valve 9 is lifted by the predetermined compression release lift amount Ld. As a result, the combustion chamber 12 continuously communicates with the exhaust passage (particularly the exhaust port 8). The compression release lift amount Ld stipulates the minimum lift amount of the exhaust valve 9 during operation of the compression release mechanism 50.

Figure 7:
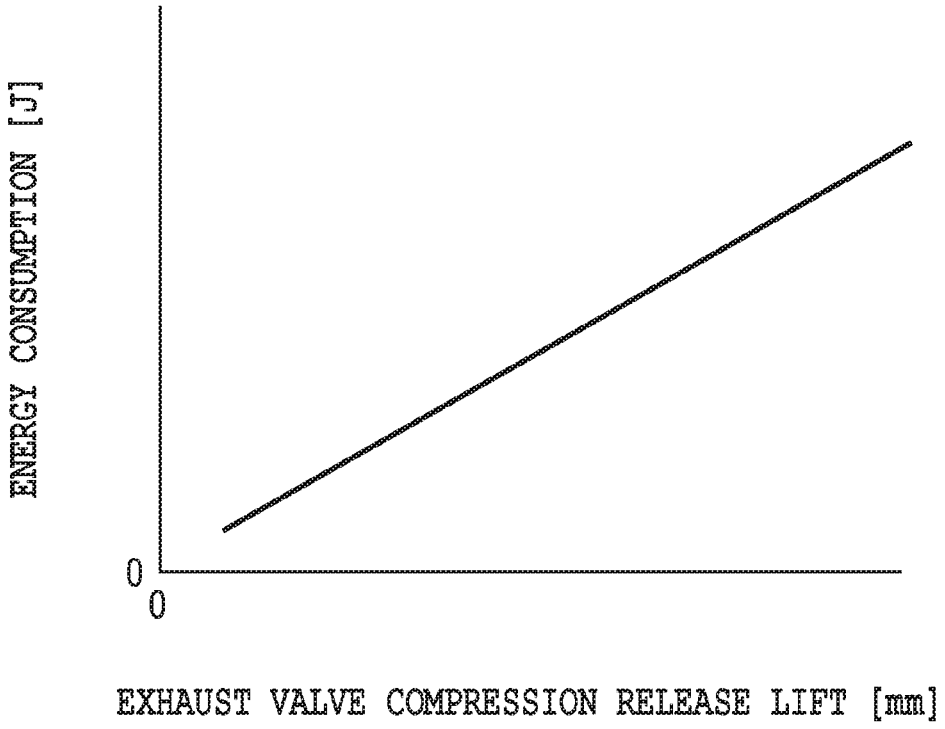
FIG. 7 is a graph illustrating a relationship between compression release lift amount and energy consumption.

Meanwhile, the energy consumption [J] required by the operation of the compression release mechanism 50 is roughly proportional to the compression release lift amount Ld. FIG. 7 illustrates the total energy consumption in the case of using the compression release actuator 57 to lift an exhaust valve over a given compression release lift amount Ld, and then return to the non-lifted state. As illustrated in FIG. 7, as the compression release lift amount Ld increases, the energy consumption required by the operation of the compression release mechanism 50 also increases. It is desirable to suppress such energy consumption required by the operation of the compression release mechanism. Given this objective, in the present embodiment, the ECU 20 executes a compression release control as discussed below.

Figure 8:
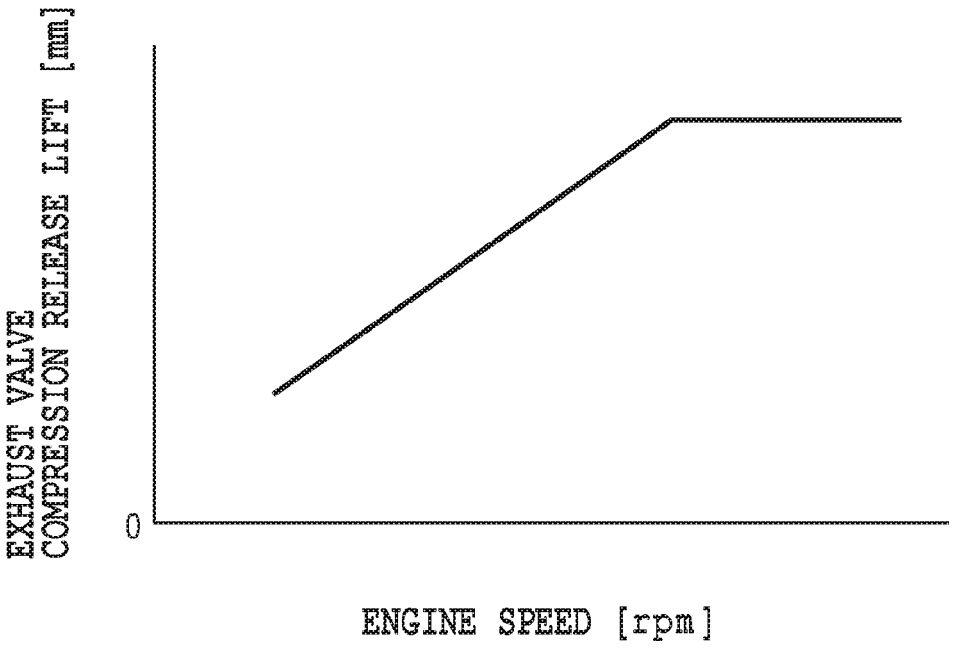
FIG. 8 is a graph illustrating an example configuration of an engine speed—lift amount map.

An engine speed—lift amount map as illustrated in FIG. 8 is created in advance and stored in the ROM of the ECU 20. The engine speed—lift amount map is an association of the speed of the engine 1 with the compression release lift amount Ld of the exhaust valve 9, and is configured so that as the engine speed rises, the compression release lift amount Ld increases proportionally and continuously. Additionally, in the engine speed—lift amount map, an upper limit is imposed on the compression release lift amount Ld, and the compression release lift amount Ld becomes a constant value in a region where the engine speed is a predetermined value or greater.

A compression release control routine executed in the present embodiment will now be described with reference to the flowchart in FIG. 9.

Figure 9:
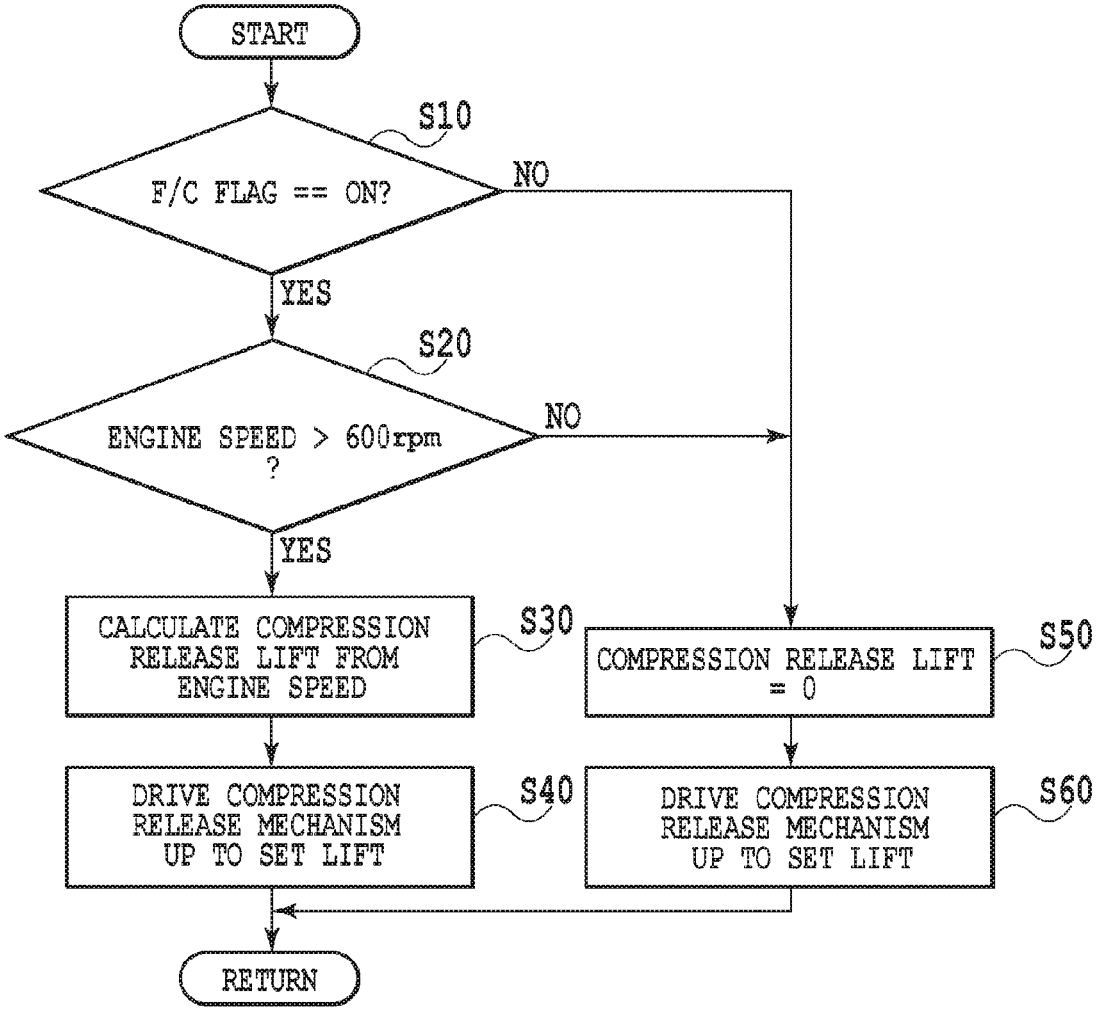
FIG. 9 is a flowchart illustrating a compression release control routine according to a first embodiment.

The routine in FIG. 9 is repeatedly executed by the ECU 20, on the condition that the power switch 39 is switched on, for example. First, in step S10, it is judged whether or not a fuel cutoff flag is on. The fuel cutoff flag is switched on if a predetermined fuel cutoff start condition is satisfied. The fuel cutoff start condition is, for example, "the accelerator position is off" and "the engine speed is at least a predetermined standard speed (for example, 2000 rpm)". This judgment is made on the basis of detected values from the crank angle sensor 35 and the accelerator position sensor 36.

Note that the fuel cutoff start condition may also include other conditions which are additional or substitutive, such as "the state of charge of the traction battery 24 is good", "the vehicle speed is falling", and "the brake pedal is on", for example. The state of charge of the traction battery may be detected by a battery monitoring unit not illustrated in the drawings (a unit that monitors the voltage, current, and battery temperature of the traction battery 24), and the vehicle speed may be detected by the speed sensor 40 provided in the vicinity of drive wheels. The contents of the condition may also be modifiable, such as "when the engine coolant temperature is lower than a predetermined cold temperature, the reference speed (for starting fuel cutoff) is raised above normal", or "when the air conditioner is running, the reference speed (for starting fuel cutoff) is raised above normal".

If the driver is travelling with the accelerator pedal depressed within a predetermined speed region and then performs an operation of releasing the accelerator pedal (for example, putting the accelerator position to zero, or in other words, the state of a fully-closed throttle valve), a positive judgment is made in step S10, and the process proceeds to step S20. In response to the operation of releasing the accelerator pedal, the throttle is changed to a fully-closed position by a separate throttle valve control, the vehicle transitions to inertial coasting, and the vehicle speed and engine speed start to fall, or in other words, decelerate. While coasting with the fuel cut off, the injection signal is switched off to prohibit or stop fuel injection by the injectors 19, and in conjunction, ignition by the spark plugs 13 is also prohibited or stopped. Subsequently, electric power is regenerated by the second motor generator MG2 under control by the ECU 20.

In step S20, it is judged whether or not the speed of the engine 1 is greater than a predetermined lower limit value (for example, 600 rpm). When the engine speed is lower than this lower limit value, even if the exhaust valve 9 is lifted by the compression release mechanism 50, the energy savings due to the reduction of engine deceleration torque are small compared to the energy consumption required by the operation of the compression release mechanism 50. Consequently, if a negative judgment is made in step S20 (that is, if the speed is less than or equal to the lower limit value), the compression release mechanism 50 does not operate.

If a positive judgment is returned in step S20 (that is, if the engine speed is greater than the lower limit value), the ECU 20 then calculates and sets the compression release lift amount Ld based on the engine speed (step S30). This calculation is conducted by calculating the engine speed on the basis of a signal from the crank angle sensor 35, and using the calculated engine speed to reference the engine speed—lift amount map discussed earlier. Consequently, in at least part of the engine speed region, the compression release lift amount Ld increases as the engine speed rises.

Next, the ECU 20 drives the compression release mechanism 50 up to the set lift amount (step S40). Consequently, the position of the exhaust valve 9 is lifted over the compression release lift amount Ld, and the process is returned.

The above fuel cutoff flag is switched off if a predetermined fuel cutoff stop condition is satisfied. The fuel cutoff stop condition may include "the driver has depressed the accelerator pedal and the accelerator degree is greater than a predetermined value", or "the engine speed has fallen near to an idling speed". When the fuel cutoff flag is switched off, the process proceeds through a negative judgment in step S10 to step S50. In step S50, the ECU 20 sets to the compression release lift amount Ld to 0. Next, the ECU 20 drives the compression release mechanism 50 to the set lift amount of 0 (step S60). Consequently, the compression release lift amount Ld of the exhaust valve 9 is set to zero, and the process is returned. The processing in steps S50 and S60 is also conducted when a negative judgment is made in step S20, or in other words, when the engine speed is less than or equal to a predetermined value.

As a result of the above processes, in the present embodiment, while coasting with the fuel cut off, the compression release mechanism 50 is driven so that the compression release lift amount Ld of the exhaust valve becomes a value according to the speed/lift map (FIG. 8). When not coasting with the fuel cut off, the compression release lift amount Ld of the exhaust valve is set to zero, and the compression release mechanism 50 is not driven.

Figure 10:
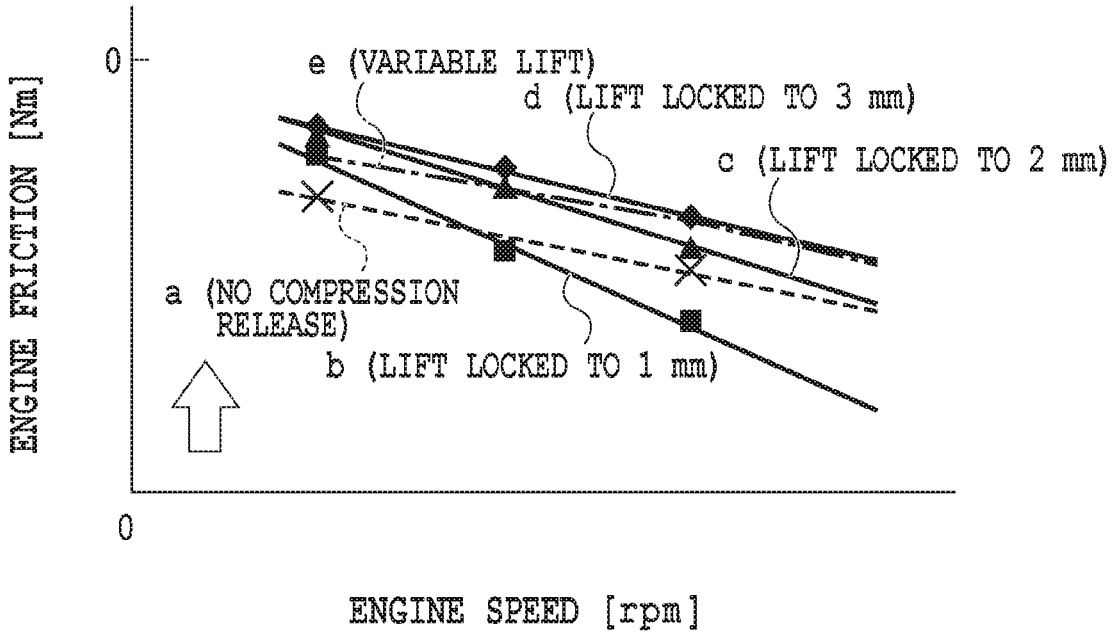
FIG. 10 is a graph illustrating a relationship between engine speed and engine friction.

FIG. 10 is a graph illustrating the relationship between engine speed and engine friction, and illustrates the case of not driving the compression release mechanism 50 (dashed line a), the case of respectively locking the compression release lift amount Ld to 1 mm, 2 mm, and 3 mm (solid lines b, c, and d), and the case of controlling the compression release mechanism 50 to obtain a compression release lift amount Ld according to an engine speed—lift amount map in accordance with the present embodiment (chain line e). Herein, engine friction refers to the engine deceleration torque (that is, the deceleration torque produced by a so-called engine brake of the engine 1), and increases in absolute value proceeding in the downward direction in FIG. 10.

As illustrated in FIG. 10, when the compression release lift amount Ld is locked to a relatively small value of 1 mm (solid line b), the absolute value of the engine friction is small compared to the case of no compression release (dashed line a) at low speeds of approximately 1000 rpm. However, at high speeds exceeding approximately 2000 rpm, pumping losses become significant, and the absolute value of the engine friction becomes large compared to the case of no compression release (dashed line a).

When the compression release lift amount Ld is locked to a larger value of 2 mm (solid line d) or 3 mm (solid line c), the absolute value of the engine friction is smaller compared to the case of no compression release (dashed line a) over the entire engine speed region. However, if the compression release lift amount Ld always takes a moderate or larger value even at low speeds of approximately 1000 rpm to 2000 rpm, the energy consumption required by the operation of the compression release mechanism 50 becomes large.

In contrast to this, in the present embodiment, the compression release mechanism 50 is driven so that compression release lift amount Ld of the exhaust valve takes a value according to the engine speed—lift amount map (FIG. 8). Consequently, the compression release lift amount Ld increases as the speed of the engine 1 rises in at least part of the speed region (particularly, the speed region less than a predetermined value). The engine friction in this case is indicated by the chain line e. For example, provided that the compression release lift amount Ld is 1 mm when lifting starts, and the maximum compression release lift amount Ld is 3 mm, the engine friction is equal to the case of locking the compression release lift amount Ld at 1 mm (solid line b) when lifting starts, but even if the speed rises, the rise in the absolute value of the engine friction is suppressed to a value equal to the case of locking the compression release lift amount Ld at 3 mm (solid line d).

Note that in a vehicle according to the present embodiment, a control that cuts off fuel supply in a high-speed region (for example, at 5500 rpm or above) in order to prevent overspeed of the engine 1 (i.e. a high-speed fuel cutoff control) may also be implemented as another form of driving with the fuel cut off. However, even in this case, the compression release lift amount Ld is kept at a constant value in such a high-speed region according to the engine speed—lift amount map in FIG. 8, and as a result, the proportionality relationship between the engine speed and the compression release lift amount Ld may also not be applied to at least part of the driving according to such a high-speed fuel cutoff control.

As thus described, in the present embodiment, when coasting with the fuel cut off, the compression release lift amount Ld of the exhaust valve increases as the speed of the engine 1 rises. For this reason, in the region of low speed of the engine 1, the energy consumption required by the operation of the compression release mechanism 50 can be suppressed, while also obtaining good response. In addition, in the region of high speed, pumping losses caused by flow losses can be suppressed, and engine friction can be suppressed. Consequently, the deceleration shock caused by engine deceleration torque can be decreased, and electric power regeneration can also be facilitated.

Note that in the first embodiment, as illustrated in the engine speed—lift amount map of FIG. 8, in the region of less than a predetermined upper limit of the speed of the engine 1, the compression release lift amount Ld is predetermined to change proportionally and continuously with respect to changes in engine speed. For this reason, shocks caused by changes in the compression release lift amount Ld may be suppressed. However, the relationship between the engine speed and the compression release lift amount Ld may also be predetermined so that the compression release lift amount Ld changes in a stepwise or discrete manner in multiple stages (that is, two or more stages) as the engine speed increases gradually.

Next, a second exemplary embodiment of the present invention will be described.

Engines having an additional mechanism to vary the opening/closing phases of not only intake valves but also the exhaust valves are widely used. The purposes of such a mechanism are various, including, but not limited to, increasing valve overlap in the medium load range by retarding the exhaust valve closing timing from a maximum advanced position that acts as a base position, improving fuel efficiency by increasing the amount of internal exhaust gas recirculation (EGR) to improve the exhaust gas composition and also decrease pumping losses, improving the volumetric efficiency of the intake air in the high load range and also the low-to-medium speed range by retarding the closing timing of the exhaust valve and advancing the closing timing of the intake valve to blow intake air back to the intake port, and improving fuel efficiency by retarding the open timing of the exhaust valve and increasing the expansion work.

Figure 11:
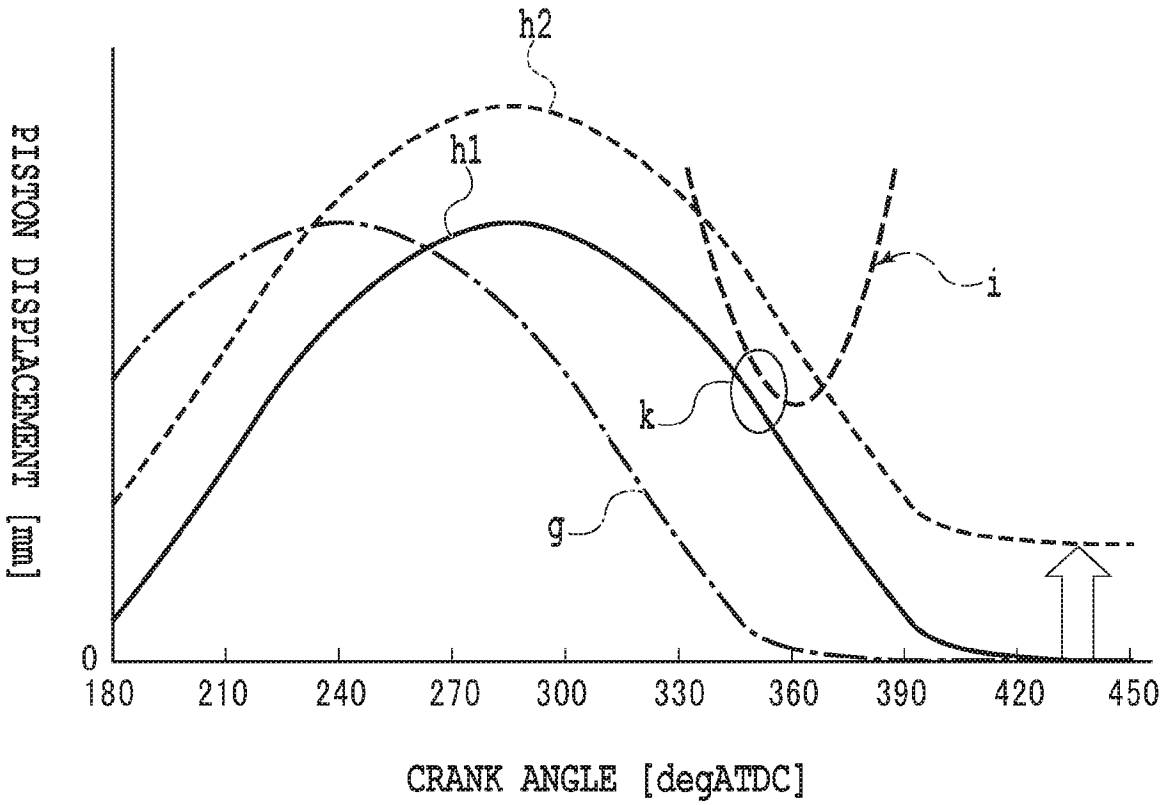
FIG. 11 is a graph illustrating exhaust valve lift amount and a piston trajectory in the case of not driving a compression release mechanism.

In an engine having such a mechanism to vary the opening/closing phases of the exhaust valve, the gap between the exhaust valve and the piston becomes smaller as the closing timing of the exhaust valve is retarded. As illustrated in FIG. 11, provided that the chain line g represents the lift amount in the case in which the opening/closing phase of the exhaust valve is at the maximum advanced position that acts as a base position, and provided that the solid line h1 represents the lift amount in the maximally retarded case, the lift in the maximally retarded case (solid line h1) is set so that the exhaust valve 9 does not interfere with the valve recess of the piston 3. The trajectory of the valve recess of the piston 3 is indicated by a dashed line i. A gap k is provided between the trajectory of the exhaust valve 9 in the maximally retarded case (solid line h1) and the trajectory of the valve recess of the piston 3 (dashed line i).

Such retardation of the closing timing of the exhaust valve may be maintained even when transitioning from normal driving, during which fuel is supplied, to coasting with the fuel cut off. Also, even when coasting with the fuel cut off, it is still conceivable to retard the closing timing of the exhaust valve 9 in order to decrease pumping losses, increase inertial travel distance, and/or increase the amount of regenerated electric power to decrease fuel consumption. However, in the case of a compression release mechanism that provides an additional opening degree to the exhaust valve 9, there is a risk that providing the compression release lift amount Ld will cause the lift amount in the maximally retarded case to take the dashed line h2, and the exhaust valve 9 to interfere with the piston 3. For this reason, in order to avoid interference between the exhaust valve 9 and the piston 3, a sufficiently large compression release lift amount Ld cannot be set. On the other hand, when an upper limit guard of a fixed value is provided to the retard angle of the variable valve timing mechanism 22 of the exhaust valve 9 in order to avoid interference between the exhaust valve 9 and the piston 3, it is necessary to set the upper limit guard to an extremely low value, as indicated by the dashed line n in FIG. 13. The second embodiment is directed at this problem, and features decreasing the upper limit on the retard angle of the exhaust valve as the additional valve opening degree provided by the compression release mechanism 50 increases, so that the exhaust valve 9 and the piston 3 do not interfere.

Figure 12:
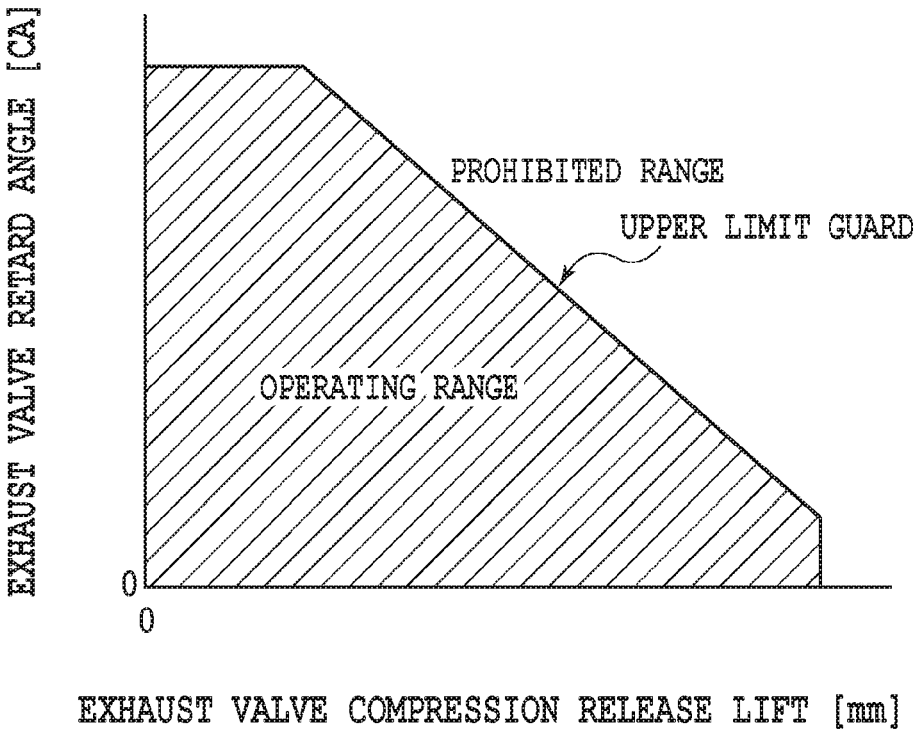
FIG. 12 is a graph illustrating an example configuration of a lift amount—retard angle map according to a second embodiment.

In the second embodiment, a lift amount—retard angle map as illustrated in FIG. 12 is created in advance and stored in the ROM of the ECU 20. The lift amount—retard angle map is an association between the compression release lift amount Ld of the exhaust valve 9 and the maximum value of the retard angle (the angle of retardation from the maximum advanced position that acts as a base position) of the variable exhaust valve timing mechanism 22. The lift amount—retard angle map is configured so that, in at least a portion thereof, the maximum value of the retard angle of the variable exhaust valve timing mechanism 22 decreases as the compression release lift amount Ld increases, so that the exhaust valve 9 and the piston head do not interfere. The maximum value of the retard angle of the variable exhaust valve timing mechanism 22 is used as the upper limit on the retard angle, or in other words, the guard value. Note that in the present embodiment, as illustrated in the lift amount—retard angle map of FIG. 12, the retard angle is predetermined to change continuously with respect to changes in the compression release lift amount Ld in at least a partial region of the compression release lift amount Ld, but the relationship between the compression release lift amount Ld and the retard angle may also be predetermined so that the retard angle changes in a stepwise or discrete manner in multiple stages (that is, at least two stages) as the compression release lift amount Ld increases gradually.

Figure 13:
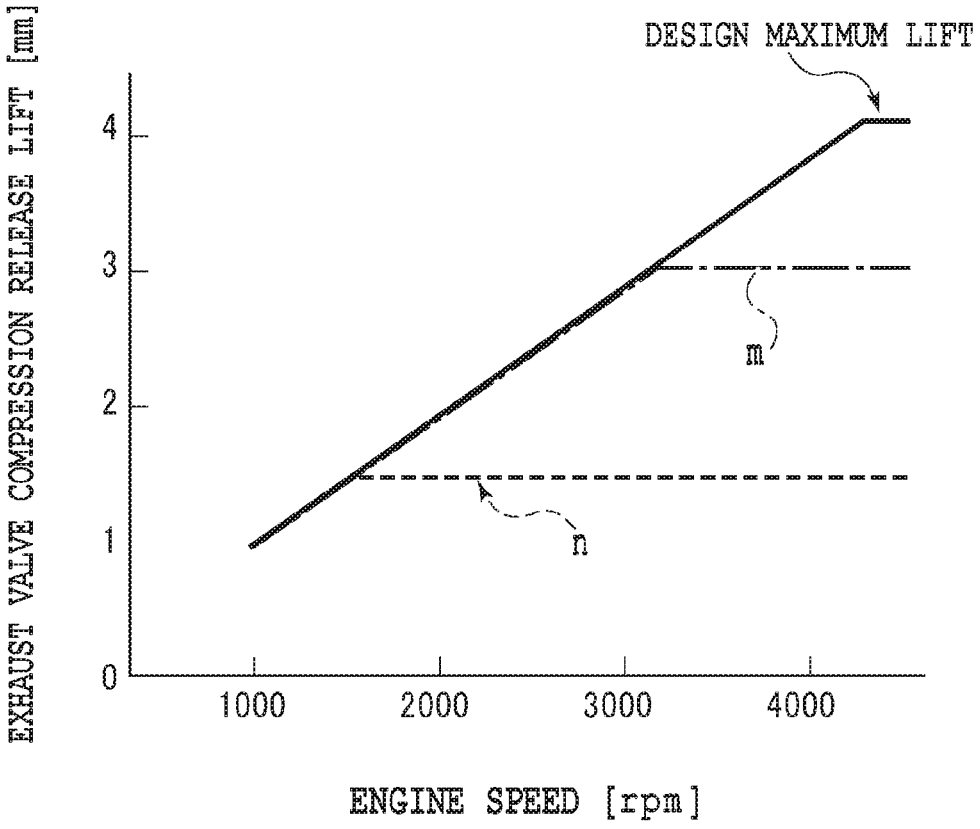
FIG. 13 is a graph illustrating an example configuration of an engine speed—lift amount map according to a second embodiment.

In the second embodiment, an engine speed—lift amount map as illustrated in FIG. 13 is created in advance and stored in the ROM of the ECU 20. On the map according to the first embodiment (FIG. 8), an upper limit is imposed on the compression release lift amount Ld (3 mm for example, indicated by the chain line m in FIG. 13) in a predetermined speed region (for example, 3000 rpm and above), for the purpose of avoiding interference between the exhaust valve 9 and the piston 3. In contrast, on the map according to the second embodiment, the upper limit on the compression release lift amount Ld is set to a higher value (4 mm for example). This is because, as a result of limiting the retard angle of the variable exhaust valve timing mechanism 22 to become smaller in the region where the compression release lift amount Ld becomes highest on the lift amount—retard angle map in FIG. 12, interference is avoided between the exhaust valve 9 and the piston 3 in this region, and a greater compression release lift amount Ld is tolerated.

A compression release control routine executed in the second embodiment will now be described with reference to the flowchart in FIG. 14.

Figure 14:
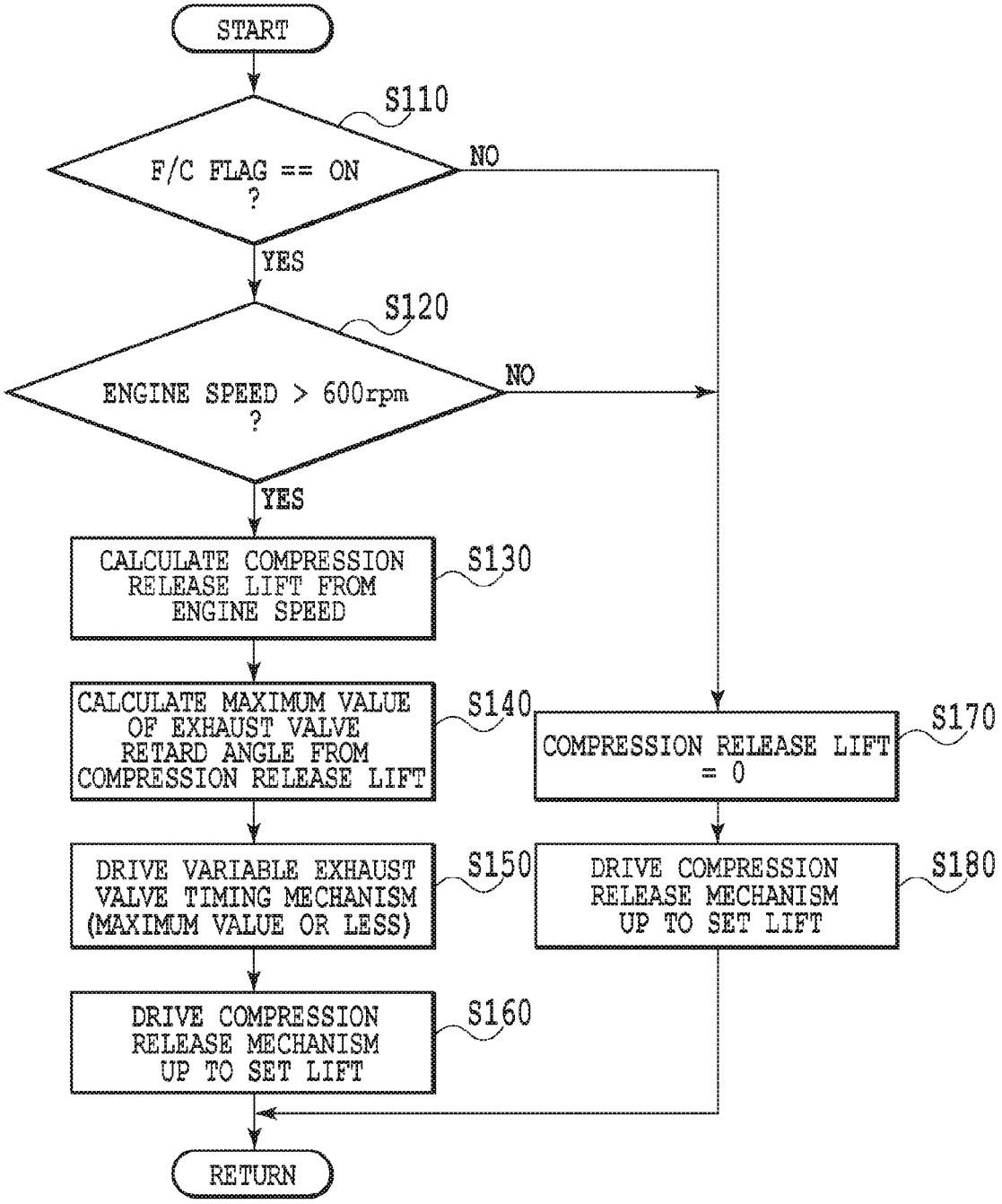
FIG. 14 is a flowchart illustrating a compression release control routine according to a second embodiment.

The routine in FIG. 14 is repeatedly executed by the ECU 20, on the condition that the power switch 39 is switched on, for example. The processing in steps S110 and S120 is similar to the processing in steps S10 and S20 in the foregoing first embodiment.

If a positive judgment is made in step S120 (that is, if the engine speed is greater than the lower limit value), the ECU 20 next calculates the compression release lift amount Ld from the engine speed (step S130). This calculation is conducted by referencing the engine speed—lift amount map discussed above (FIG. 13). Consequently, as the engine speed rises, the compression release lift amount Ld is made larger.

Next, the ECU 20 calculates the maximum value of the retard angle from the compression release lift amount Ld (step S140). This calculation is conducted by referencing the lift amount—retard angle map discussed above (FIG. 12). Consequently, in at least a part of the full region of the compression release lift amount Ld, the maximum value of the retard angle of the variable exhaust valve timing mechanism 22 is made smaller as the compression release lift amount Ld rises.

Next, the ECU 20 drives the variable exhaust valve timing mechanism 22 at the above maximum value or less (step S150), and drives the compression release mechanism 50 up to the set compression release lift amount Ld (step S160). Consequently, the variable exhaust valve timing mechanism 22 is retarded within the range of the above maximum value or less while the position of the exhaust valve 9 is lifted over the compression release lift amount Ld, and the process is returned. As a result of a separate variable valve timing mechanism control by the ECU 20, the retard angle of the variable exhaust valve timing mechanism 22 is determined on the basis of the engine speed and demanded load, for example, for the purpose of improving vehicle performance, fuel efficiency, and/or emissions quality. The demanded load may be determined on the basis of the accelerator position. As discussed above, even when coasting with the fuel cut off, the operation timing of the exhaust valve 9 sometimes may be retarded from the maximum advanced position. In the present embodiment, step S150 imposes an upper limit on the retard angle determined by this variable valve timing mechanism control.

When the driver depresses the accelerator pedal and the accelerator position becomes greater than a predetermined value (step S110, No), and when the engine speed is a predetermined value or less (step S120, No), the processing in steps S170 and S180 is conducted. The processing in steps S170 and S180 is similar to the processing in steps S50 and S60 in the foregoing first embodiment. Consequently, the compression release lift amount Ld of the exhaust valve 9 is set to zero, and the process is returned.

Figure 15:
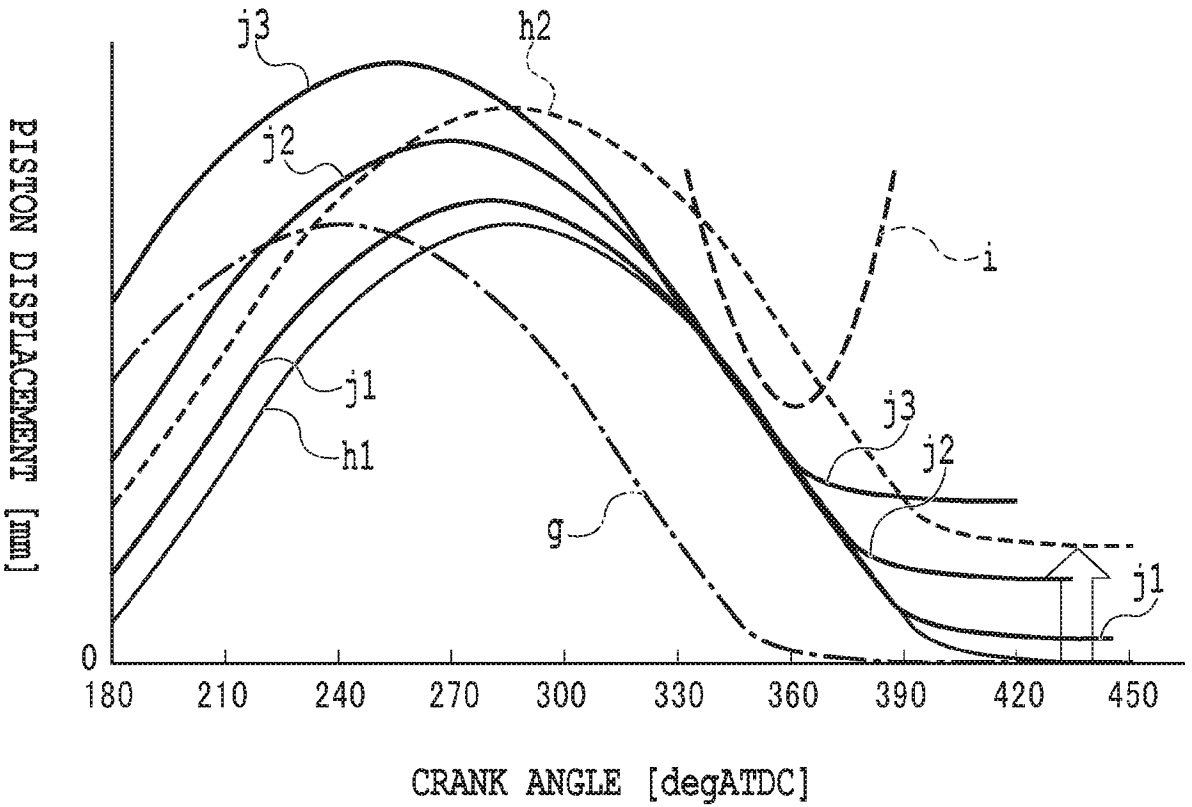
FIG. 15 is a graph illustrating exhaust valve lift amount and a piston trajectory in the case of driving a variable exhaust valve timing mechanism and a compression release mechanism according to a second embodiment.

As a result of the above process, in the second embodiment, the upper limit on the retard angle of the exhaust valve 9 is made smaller as the additional valve opening degree for the exhaust valve 9 provided by the compression release mechanism 50 (that is, the compression release lift amount Ld) increases. As illustrated in FIG. 15, the solid line j1 represents the lift amount corresponding to the maximum value of the retard angle when the compression release lift amount Ld is a comparatively small Ld1. In contrast, the solid line j2 represents the lift amount corresponding to the maximum value of the retard angle when the compression release lift amount Ld is Ld2, which is greater than Ld1. The phase of the solid line j2 is more advanced than the solid line j1. Similarly, the solid line j3 represents the lift corresponding to the maximum value of the retard angle when the compression release lift amount Ld is Ld3, which is greater than Ld2 (Ld3 is the maximum value tolerated by the design of the compression release mechanism 50). The phase of the solid line j3 is more advanced than the solid line j2. None of the lifts j1, j2, or j3 interferes with the trajectory of the valve recess of the piston 3 (dashed line i).

As thus described, in the second embodiment, the upper limit on the retard angle of the exhaust valve 9 is made smaller as the additional valve opening degree provided by the compression release mechanism 50 increases, so that the exhaust valve 9 and the piston 3 do not interfere. Consequently, even when the valve opening degree of the exhaust valve 9 is increased by the operation of the compression release mechanism 50, flow losses may be suppressed while also preventing interference between the exhaust valve 9 and the piston head caused by the retardation of the exhaust valve 9.

Next, a third embodiment of the present invention will be described.

In the foregoing first embodiment, when coasting with the fuel cut off, the compression release lift amount Ld of the exhaust valve 9 is made larger as the speed of the engine 1 rises. For this reason, in the region of high speed, pumping losses caused by flow losses may be suppressed, and engine friction may be suppressed. However, there is a problem in that, even though the engine speed is in the high region, there is little sense of deceleration caused by the engine deceleration torque, which may feel unnatural to the driver. The third embodiment is directed at this problem, and features controlling the deceleration torque produced by the generator according to the difference in power loss between when the compression release mechanism 50 is operating and not operating.

Figure 16:
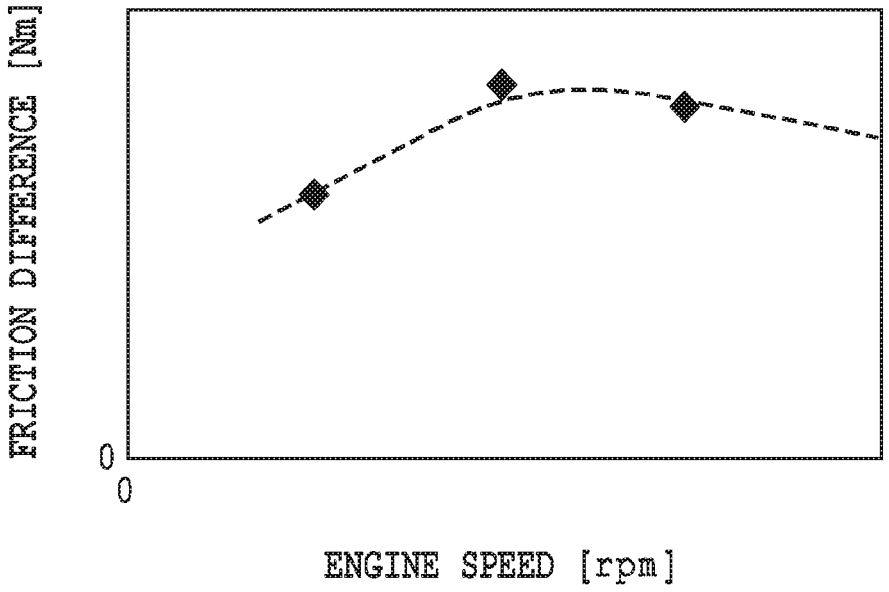
FIG. 16 is a graph illustrating an example configuration of an engine speed—friction difference map according to a third embodiment.

In the third embodiment, the deceleration torque of the second motor generator MG2 is made to increase to compensate for the decrease in engine deceleration torque caused by the operation of the compression release mechanism 50 (hereinafter referred to as a friction difference). Herein, the friction difference refers to the difference in power loss [Nm] between when the compression release mechanism 50 is operating and not operating. The friction difference is the value obtained by subtracting the absolute value of the power loss when the compression release mechanism 50 is operating from the absolute value of the power loss when the compression release mechanism 50 is not operating, the latter corresponding to the engine speed as indicated by the dashed line a in FIG. 10. The power loss when the compression release mechanism 50 is operating and not operating can be calculated in advance by experiments or simulations. In the present embodiment, since the compression release lift amount Ld is determined according to the engine speed as indicated by the chain line e in FIG. 10, similarly to the first embodiment, the friction difference can be unambiguously calculated from the engine speed. For this reason, in the present embodiment, an engine speed—friction difference map as illustrated in FIG. 16 is created in advance and stored in the ROM of the ECU 20.

Figure 17:
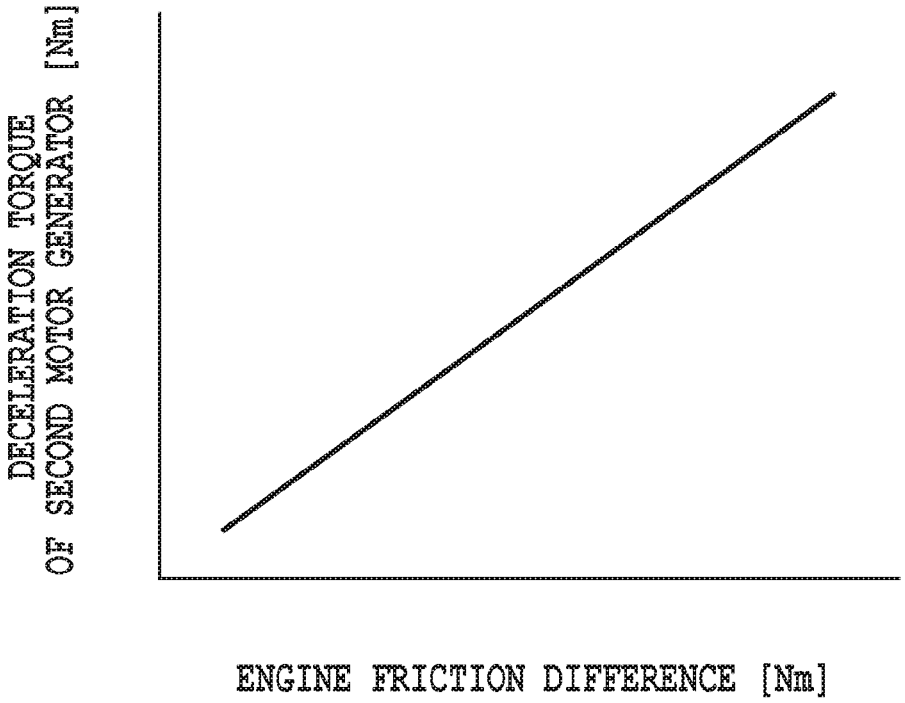
FIG. 17 is a graph illustrating an example configuration of a friction difference—MG deceleration torque map according to a third embodiment.

Also, in the present embodiment, a friction difference—MG deceleration torque map as illustrated in FIG. 17 is created in advance and stored in the ROM of the ECU 20. This map is configured so that the target deceleration torque of the second motor generator MG2 increases to compensate for the decrease in mechanical load (that is, engine deceleration torque) caused by the operation of the compression release mechanism 50. On this map, the friction difference and the target deceleration torque of the second motor generator MG2 are set equal. An increase in the deceleration torque of the second motor generator MG2 is executed by having the driving circuit 23 increase the excitation current to supply to the field magnet of the second motor generator MG2. As a result, as the friction difference increases, the deceleration torque of the second motor generator MG2 is increased and the generated electric power is increased, thereby facilitating electric power regeneration.

A compression release control routine executed in the third embodiment will now be described with reference to the flowchart in FIG. 18.

Figure 18:
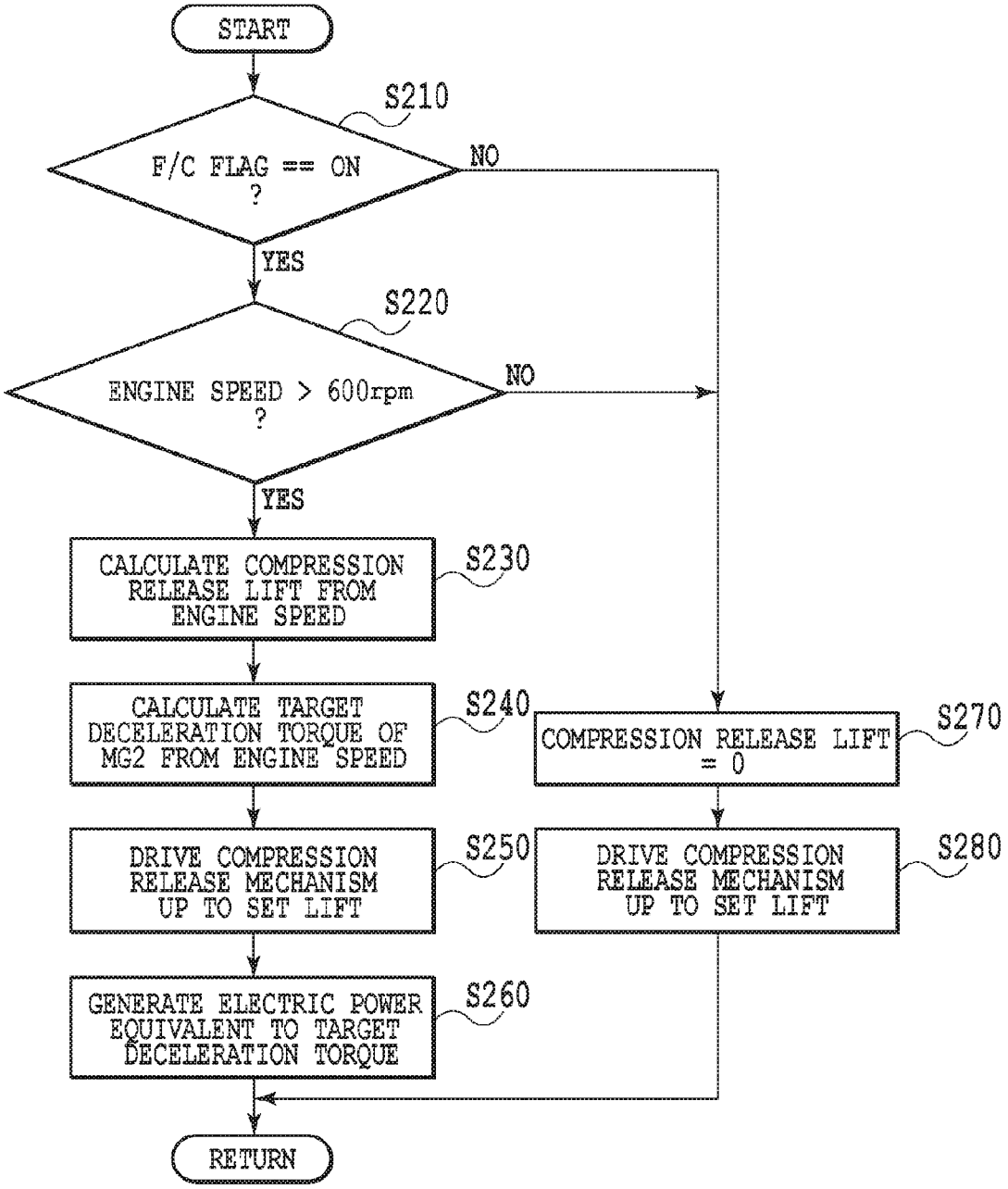
FIG. 18 is a flowchart illustrating a compression release control routine according to a third embodiment.

The routine in FIG. 18 is repeatedly executed by the ECU 20, on the condition that the power switch 39 is switched on, for example. The processing in steps S210 to S230 is similar to the processing in steps S10 to S30 in the foregoing first embodiment.

After calculating the compression release lift amount Ld from the engine speed in step S230, next, the ECU 20 calculates the target deceleration torque of the second motor generator MG2 on the basis of the engine speed (step S240). In step S240, the ECU 20 first references the above engine speed—friction difference map in FIG. 16 to calculate the friction difference on the basis of the engine speed, and also references the above friction difference—MG deceleration torque map in FIG. 17 to calculate the target deceleration torque on the basis of the friction difference.

Next, the ECU 20 drives the compression release mechanism 50 up to the set lift amount Ld (step S250). Consequently, the opening degree of the exhaust valve 9 is lifted over the lift amount Ld. Subsequently, the ECU 20 controls the excitation current of the second motor generator, generates power equivalent to the amount of target deceleration torque (step S260), and the process is returned.

When the driver depresses the accelerator pedal and the accelerator position becomes greater than a predetermined value (step S210, No), and when the engine speed is a predetermined value or less (step S220, No), the processing in steps S270 and S280 is conducted. The processing in steps S270 and S280 is similar to the processing in steps S50 and S60 in the foregoing first embodiment. Consequently, the compression release lift amount Ld of the exhaust valve 9 is set to zero, and the process is returned.

As a result of the above process, in the third embodiment, the deceleration torque produced by the second motor generator MG2 is controlled according to the difference in the power loss between when the compression release mechanism 50 is operating and not operating. Consequently, the lessened sense of deceleration caused by the operation of the compression release mechanism 50 can be minimized, while also making it possible to facilitate power generation by the second motor generator.

In addition, in the present embodiment, the deceleration torque of the second motor generator MG2 is made to increase to compensate for the decrease in engine deceleration torque caused by the operation of the compression release mechanism 50. Consequently, it is possible to provide the driver with a sense of deceleration similar to the case when the compression release mechanism 50 is not operating.

Note that in the third embodiment, the friction difference and the target deceleration torque of the second motor generator MG2 are set equal to each other, but the target deceleration torque and the friction difference may also be different. Preferably, the target deceleration torque takes a value proportional to the friction difference. Also, when the achievable deceleration torque is smaller than the friction difference because of a limit on the deceleration torque produced by the second motor generator MG2 imposed by the ECU 20, the compression release lift amount Ld may be decreased to compensate for the lacking deceleration torque and achieve a sense of deceleration similar to when the compression release mechanism is not operating at all. Also, a user operation using a selecting measure such as a shift lever (not illustrated), for example, may also be implemented to enable selection between a running mode of running with a deceleration torque decreased by the operation of the compression release mechanism as in the first embodiment, and a running mode that achieves a sense of deceleration similar to when the compression release mechanism is not operating at all as in the third embodiment.

In addition, in the third embodiment, as illustrated in the friction difference—MG deceleration torque map of FIG. 17, the target deceleration torque of the second motor generator MG2 is predetermined to change proportionally and continuously with respect to changes in the friction difference, but the relationship between the friction difference and the target deceleration torque may also be predetermined so that the target deceleration torque changes in a stepwise or discrete manner in multiple stages (that is, at least two stages) as the friction difference increases gradually.

The present disclosure is not limited to the foregoing embodiments, and any modifications, applications or their equivalents that are encompassed by the ideas of the present disclosure as stipulated by the claims are to be included in the present disclosure. Consequently, the present invention is not to be interpreted in a limited manner, and is also applicable to other arbitrary technologies belonging within the scope of the ideas of the present invention. For example, the present invention may also be modified as follows.

Figure 19:
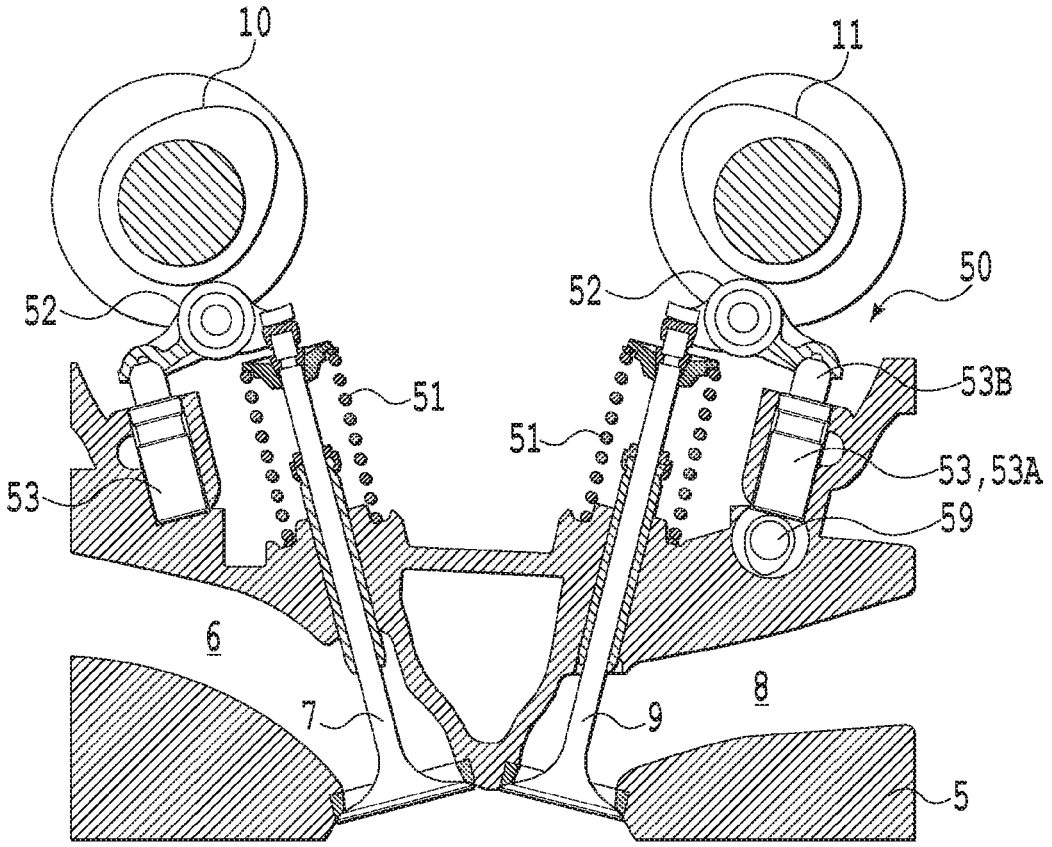
FIG. 19 is an enlarged front cross-section illustrating a modification of a compression release mechanism.
Figure 20:
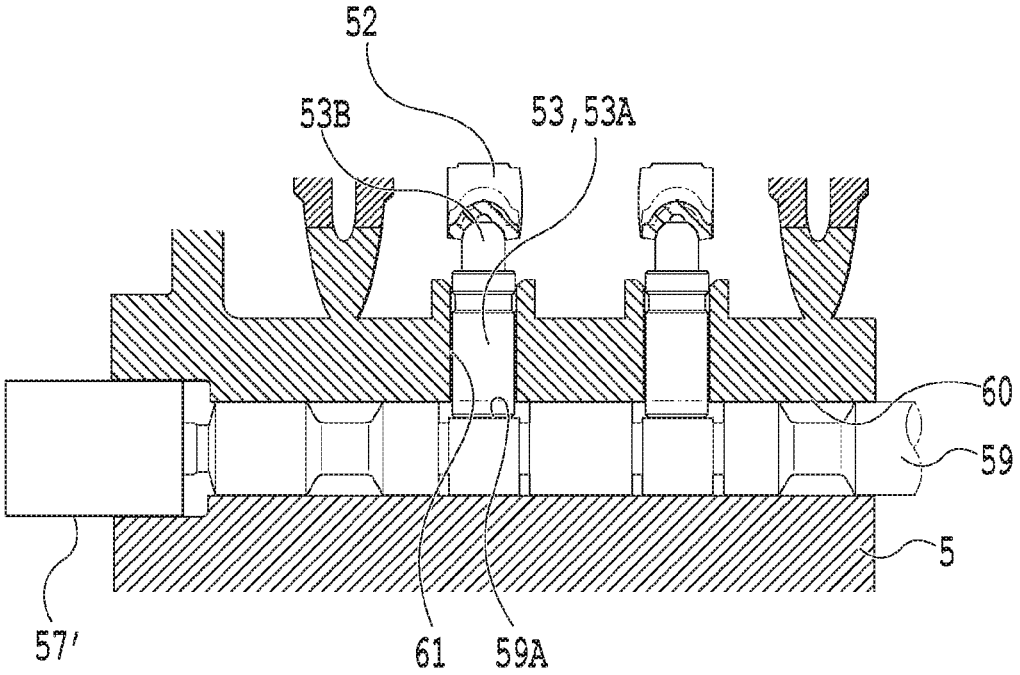
FIG. 20 is an enlarged side cross-section illustrating a modification of a compression release mechanism.

(1) The configuration of the compression release mechanism 50 may be modified as illustrated in FIGS. 19 and 20. This exemplary modification is configured so that instead of the slider 55, an HLA lifter cam shaft 59 is used to lift the HLA 53. The HLA lifter cam shaft 59 is rotatably inserted into and supported by a cam shaft insertion hole 60 formed in the cylinder head 5 so as to face the floor of each HLA 53, and rotatably driven by a motorized compression release actuator 57'. Note that the HLA holders 54 discussed earlier are omitted, and instead, the HLAs 53 are supported by HLA support holes 61 formed in the cylinder head 5 while allowing for up-and-down movement.

When the compression release mechanism 50 operates, the motorized compression release actuator 57' is switched on, and the motorized compression release actuator 57' rotates the HLA lifter cam shaft 59 from the stopped position illustrated in FIG. 20 to an operating position that differs by 180° (indicated by the virtual line). Subsequently, the cam face 59A of the HLA lifter cam shaft 59 directly pushes up and lifts the HLA 53 upward. The modification is similar to the base embodiment in all other aspects.

(2) Various other configurations of the compression release mechanism besides the above are also possible. A compression release mechanism that connects the combustion chamber and the intake passage at least during the compression stroke can be used. A compression release mechanism that connects the combustion chamber to both the intake passage and the exhaust passage at least during the compression stroke can also be used. In the case of implementing an electromagnetically driven exhaust valve that drives the exhaust valve with an electromagnetic actuator, the compression release mechanism may be configured by the electromagnetically driven exhaust valve. The first and third embodiments of the present invention may also be applied favorably to a compression release mechanism having a dedicated valve member that does not divert the exhaust valve.

(3) The type of vehicle is arbitrary, and may also be an engine vehicle that is not a hybrid vehicle, or in other words, a vehicle whose only source of power is an internal combustion engine. In the case of an engine vehicle, instead of the second motor generator MG2, an alternator (synchronous generator) not used as a power source for travel may be used for electric power regeneration. In an engine vehicle, the condition for executing coasting with the fuel cut off in times of vehicle braking demand may be either the same as or different to that described for a hybrid vehicle in the foregoing first embodiment. The standard speed at which to start fuel cutoff may be configured to be comparatively lower for a diesel engine compared to a gasoline engine, such as 850 rpm, for example.

The above thus describes preferred embodiments of the present invention in detail, but various other embodiments of the present invention are also conceivable. The foregoing embodiments, examples, and configurations may also be arbitrarily combined in non-contradictory ways. Any modifications, applications or their equivalents that are encompassed by the ideas of the present disclosure as stipulated by the claims are to be included in the embodiments of the present invention. Consequently, the present invention is not to be interpreted in a limited manner, and is also applicable to other arbitrary technologies belonging within the scope of the ideas of the present invention.

The invention claimed is:

1. An apparatus for controlling an internal combustion engine comprising:

a compression release mechanism controller configured to control a compression release mechanism that variably controls an opening degree of a valve member, the compression release mechanism being a mechanism that connects a combustion chamber of an internal combustion engine of a vehicle to at least one of an intake passage and an exhaust passage by the opening degree of the valve member, at least during a compression stroke; and a fuel cutoff controller configured to control a fuel injection valve that supplies fuel to the combustion chamber of the internal combustion engine to execute coasting with the fuel cut off, in which the supply of fuel is cut off under a predetermined condition, wherein the compression release mechanism controller is further configured to increase, during execution of coasting with the fuel cut off and in a case where the speed of the internal combustion engine is greater than a predetermined lower limit value, the opening degree of the valve member of the compression release mechanism as the speed of the internal combustion engine increases and is further configured to control the compression release mechanism not to operate, during execution of coasting with the fuel cut off and in a case where the speed of the internal combustion engine is equal to or smaller than the predetermined lower limit value, the valve member is an exhaust valve of the internal combustion engine, the compression release mechanism is configured to provide an additional opening degree to the exhaust valve, the internal combustion engine further comprises a variable valve timing mechanism configured to change an operation timing of the exhaust valve, the additional opening degree being provided to the opening degree of the valve when the compression release mechanism is not operated, and the apparatus further comprises a valve timing controller configured to control the variable valve timing mechanism, and the valve timing controller is further configured to decrease an upper limit of a retardation of the operation timing of the exhaust valve as the additional valve opening degree increases so that the exhaust valve does not interfere with a piston of the internal combustion engine.

2. The apparatus for controlling an internal combustion engine according to claim 1, wherein the internal combustion engine further comprises an electric generator mechanically coupled to the output shaft thereof, and the apparatus further comprises an electric generator controller configured to control output from the electric generator, and the electric generator controller is further configured to increase a deceleration torque produced by the electric generator as a difference in power loss between when the compression release mechanism is operating and not operating increases.

* * * * *